US007168456B1

(12) United States Patent
Kuster et al.

(10) Patent No.: US 7,168,456 B1
(45) Date of Patent: Jan. 30, 2007

(54) METHOD AND APPARATUS TO REMOVE YARNS FROM THE FRINGES OF AN INDUSTRIAL TEXTILE

(75) Inventors: Heinz (Heikki) Kuster, Sandpoint, ID (US); Raymond Lee Seeman, Troy, MT (US)

(73) Assignee: North Rocky Robot Technology, Inc. (NORTEC), Sandpoint, ID (US)

( * ) Notice: Subject to any disclaimer, the term of this patent is extended or adjusted under 35 U.S.C. 154(b) by 0 days.

(21) Appl. No.: 11/259,997

(22) Filed: Oct. 26, 2005

(51) Int. Cl.
*D06C 13/00* (2006.01)
*D06H 5/00* (2006.01)
*D03D 3/04* (2006.01)
*D03D 49/50* (2006.01)

(52) U.S. Cl. ..... 139/170.4; 139/383 AA; 139/302; 28/142; 28/141; 26/10.4

(58) Field of Classification Search ..... 139/383 AA, 139/170.4, 302; 26/10.4; 28/141, 142
See application file for complete search history.

(56) References Cited

U.S. PATENT DOCUMENTS 4,244,084 A * 1/1981 Gisbourne ..... 24/33 C
4,736,499 A * 4/1988 Kopcke ..... 281/41
4,985,970 A * 1/1991 Krenkel et al. ..... 28/141
5,117,542 A * 6/1992 Krenkel et al. ..... 28/141
5,390,708 A * 2/1995 Kuster et al. ..... 139/383 AA
5,411,063 A * 5/1995 Hacker et al. ..... 139/383 AA
5,421,373 A * 6/1995 Hacker et al. ..... 139/192
5,720,323 A * 2/1998 Tremer ..... 139/446
5,992,471 A * 11/1999 Chung ..... 139/116.2
6,014,797 A * 1/2000 Kuster et al. ..... 28/146
6,206,051 B1 * 3/2001 Arie ..... 139/194

* cited by examiner

*Primary Examiner*—John J. Calvert
*Assistant Examiner*—Robert Muromoto

(57) ABSTRACT

A method and apparatus for the removal of one or more lateral yarns from a woven industrial textile to prepare it for seaming. The apparatus consists of a movable table, a clamping device to hold the fabric, and a yarn removal device, consisting of a cutter and a combined hooked needle & thread catcher. In operation, the yarn removal device moves both vertically into and out of the fabric plane, and horizontally parallel to the longitudinal yarns. The yarn removal device pierces the fabric at two locations, cuts one or more yarns, and then grasps the cut section(s) to pull them down and out of the fabric plane. The cycle is repeated to form a longitudinal channel of desired length; the device is then moved laterally and the cycle repeated until an open channel parallel with the lateral fabric edge is accomplished.

7 Claims, 12 Drawing Sheets

METHOD AND APPARATUS TO REMOVE YARNS FROM THE FRINGES OF AN INDUSTRIAL TEXTILE

FIELD OF THE INVENTION

The present invention relates to a method and apparatus for the automated removal of yarns from the fringes of an industrial textile. It is particularly concerned with such a method and apparatus wherein the yarn removal is accomplished by cutting and pulling the desired yarns without causing damage to the fabric or any adjacent yarns.

BACKGROUND OF THE INVENTION

Modern papermaking machines and similar continuous process apparatus require industrial textiles to convey and dewater the filtrate through each section of the machine. Such textiles include, for example, forming fabrics, press felts and dryer fabrics; other similar fabrics are known and used. These textiles may be quite wide, up to 400 inches (10 m) or more, and are generally flat woven (although so-called endless woven fabrics are used as well), and are seamed so as to render them endless. A variety of seam types are known, including those which are more or less invisibly woven into the fabric so that the seam area does not present a discontinuity of fabric properties to the filtrate being conveyed. Such seams are referred to as woven seams and are commonly used in forming fabrics, which are designed to convey and support the papermaking fibers as the embryonic web is consolidated by drainage of fluid from the initially very dilute stock slurry which has been deposited onto the fabric.

The embryonic web is prone to marking and it is thus important that the seam present a uniform surface which is as similar as possible to the woven fabric structure. Therefore, a woven seam is preferred over other seam types for forming fabric applications because it provides less of a discontinuity in fabric properties. Other seam types, such as pin seams, coil seams and the like may be appropriate for use in press felts and dryer fabrics which are less prone to sheet marking. In order to weave the ends of a flat woven fabric together to form a woven seam, weft or cross-machine direction (CD) oriented yarns are removed from each fabric end in a process called "unraveling" to expose a fringe of warp or machine direction (MD) oriented yarns. The fringes are then overlaid, trimmed as necessary and the warp yarns rewoven with the weft yarns to form the seam. Automated seaming machines are often used for this purpose.

It will be appreciated that preparing the fringes of a papermaker's forming fabric for automated seaming can be a lengthy and laborious process requiring a high degree of skill and experience, particularly as these fabrics can be very finely woven, multilayer structures employing yarns whose diameters are in the range of from about 0.12 mm up to about 0.75 mm or more. Recently, automated means have become available which speed up the fringing process and reduce the amount of manual labor required.

In the unraveling process to prepare a fabric for seaming, short sections of the component weft yarns are cut, either by manual or automated means, and the cut yarn sections are then pulled out of the fabric. Care must be taken because, if the length of the sections of the cut weft yarns is too long, or the force used to pull them out is too great, the underlying warp threads can be damaged, resulting in discontinuities in the eventual seam. In addition, any crimp imparted to the yarns during the weaving process may be destroyed, making it difficult if not impossible to create a uniform woven seam.

Known apparatus for preparing a textile fringe for seaming use a hooked needle which penetrates the fabric from one side at a pre-selected distance from the end of the weft thread to be removed, and pulls the weft thread or threads that hook onto the needle out of the fabric on the needle's return stroke. The pulled out weft thread sections are then cut away. The disadvantage with such devices is that, each time the tip of the needle pierces the fabric, warp ends which are in close proximity to the piercing needle can be damaged or cut by the needle. In addition, each time the needle pierces the textile, there is a risk that the needle will split or cut warp yarns. Because the needle may pierce the fabric as many as 140 times for each inch of textile width (55 times/cm) and each quarter inch (0.64 cm) of weft threads pulled out, the risk of damage or breakage to the warp yarns when preparing a 30 foot (9.1 m) wide fabric for example occurs 200,000 times for every inch (2.54 cm) of fabric that is unraveled.

U.S. Pat. No. 4,736,499 to Köpcke (the '499 patent) discloses a device for automating the unraveling process to provide a fabric fringe suitable for spiral seaming. Spiral seaming involves the insertion of a plastic spiral into a narrow fringed channel across the width of the two fabric ends that are to be joined. In the device according to the '499 patent, an unraveling unit uses a plurality of vertically reciprocating needles in combination with a cutter to pull out and cut sections of weft thread. The unit travels across the width of the fabric unraveling a number of yarns corresponding to the number of needles in the unraveling unit.

This can be disadvantageous in certain instances because, if a wider fringe is required, then the unit must be repositioned and the unraveling process repeated across the entire width of the fabric. Although a narrow fringe of from two to ten threads in width is sufficient for spiral seaming, a woven seam such as would be used in a papermaker's forming fabric requires a larger fringe of from about 1 inch (2.54 cm) to about 10 inches (25.4 cm) in width. This will require the removal of hundreds of weft threads and numerous passes of the device. A second deficiency of this fringing device is that it employs a mechanical sensor to follow the channel between two adjacent weft threads and ensure straight tracking of the unraveling unit. This sensor may not track properly across fabrics with tight or multilayered weaves. A third deficiency is that the device uses a trailing cutter to cut the pulled threads after they have been released by the needles; such a cutter may not function adequately on soft-fibered fabrics, as soft threads may not be stiff enough to maintain their position as the cutter moves into them. Thus, the device disclosed in the '499 patent may not be suitable for applications other than preparing fabrics for spiral seaming.

U.S. Pat. No. 6,014,797 to Kuster et al. (the '797 patent) discloses another device for automatically unraveling a fringe area in a fabric. This device uses a reciprocating, hooked needle and a reciprocating blade to pierce the fabric, pull one or more interwoven weft yarn tails out of the woven fabric structure, and then cut the tails off when they are displaced from the fabric plane. The needle and hook are advanced in the parallel direction to the longitudinal warp yarns, unraveling the weft yarns until a fringe area of a desired width has been formed. The apparatus is then moved laterally along the edge of the fabric to the next unraveling location and the cycle is repeated until the fringe area extends to the desired width along the length of the fabric edge.

A disadvantage of this device is that, each time the needle pierces the fabric, there is a potential to damage or even break warp threads that are in close proximity to the needle. Because the needle need to be pulled out of the plane of the textile to give space for the cutter to cut the pulled out yarn tails. Damage to the remaining MD yarns may occur after each time the needle pierce the fabric again. An additional disadvantage is that the thread(s) hooked into the needle may slide and break.

Thus, it would be desirable if a method and apparatus were available which provided reliable capture of the fringe yarns with reduced risk of breakage and which was adjustable to fringe a desired width of fabric in preparation for a seaming process. It would be particularly desirable if such a method and apparatus could be used in multilayer fabrics which are woven at high yarn density, without causing damage to any of the component yarns used in seam formation.

The present invention seeks to provide a novel method and apparatus for the automated and reliable unraveling of one or multiple weft threads in a woven industrial textile such as a papermaker's fabric. The apparatus creates a longitudinal MD oriented channel in the fabric in which all of the CD oriented yarns have been removed and all of the MD yarns are left undamaged and available for use in seam formation. In addition, the method and apparatus of this invention provides for the automated unraveling of yarns in a multilayer woven fabric, which fabric is woven at a yarn density of about 180 yarns per inch or more. Further, the method and apparatus of this invention are able to remove yarns having both circular and non-circular cross sectional shape.

The method and apparatus of this invention are suitable for use in a variety of industrial textiles, including papermaker's fabric and similar filtration and separation fabrics which require a seam.

SUMMARY OF THE INVENTION

According to a first aspect of the present invention, there is provided an apparatus for the removal of one or more CD oriented yarns from an edge of a woven industrial textile having first and second planar surfaces and comprised of a plurality of interwoven warp and weft yarns oriented transversely to one another in each of the machine direction (MD) and cross-machine direction (CD), the apparatus comprising:

a. a frame that is at least equal in length to the width of the fabric from which the yarns are to be removed;

b. a movable table including:

i. a motorized mounting system attached to the frame, the mounting system capable of moving the table a desired distance along the frame in a direction generally parallel to the CD direction of the fabric;

ii. a clamping device adapted to securely hold that portion of the fabric from which yarns are to be removed; and iii. a yarn removal device, consisting of a cutter and a combined hooked needle & thread catcher, wherein;

1. the yarn removal device is movable in a vertical direction out of the fabric plane, and in a horizontal direction parallel to the MD direction;

2. the distance between the cutter and combined hooked needle & thread catcher in the yarn removal device is adjustable;

3. the yarn removal device is caused to reciprocate cyclically such that:

A. in a first part of the cycle, the yarn removal device is raised and each of the cutter and combined hooked needle & thread catcher pierces a first planar surface of the fabric thereby passing between the component warp and weft yarns at two locations a pre-selected distance apart;

B. the cutter cuts one or more weft yarns as it passes between the component warp and weft so as to provide cut weft thread sections;

C. in a second part of the cycle, the hook of the combined hooked needle & thread catcher grasps the one or more pre cut weft yarn section(s) and pulls them down into the clamp of the thread catcher, thereby holding the hooked weft yarn section(s) firmly and pulling the section(s) completely out of the fabric as the cutter and combined hooked needle & thread catcher are retracted from the first planar surface;

D. in a third part of the cycle, the thread catcher releases the pulled out cut weft yarn section, and the cutter and combined hooked needle & thread catcher are moved in a horizontal direction parallel to the MD to the next uncut weft yarn(s), and the cycles repeat until a desired width of longitudinal channel is obtained;

c. the table is moved in a direction generally parallel to the CD of the fabric and the cycle is repeated until sufficient CD yarns are removed from a desired width and length of the fabric.

According to another aspect of the present invention, there is provided a method of removing one or more CD oriented yarns from an edge of a woven industrial textile, the method comprising:

(i) providing a woven industrial textile containing interwoven warp and weft yarns;

(ii) clamping a first portion of the textile from which the CD oriented yarns are to be removed;

(iii) locating a yarn removal device, consisting of a cutter and a combined hooked needle & thread catcher assembly, at a first location in the fabric edge where yarn removal is to begin;

(iv) separating and locating the individual cutter and combined hooked needle & thread catcher a desired CD distance from each other;

(v) simultaneously piercing the industrial textile from one side with both the cutter and the combined hooked needle & thread catcher at separate locations spaced apart from one another parallel to the CD;

(vi) cutting one or more weft yarns with the cutter;

(vii) examining the cutter and hooked needle & thread catcher with sensor means to ensure damage has not occurred during the piercing process;

(viii) retracting the cutter and combined hooked needle & thread catcher such that the hook on the combined hooked needle & thread catcher captures at least one cut weft yarn section and pulls this section into the clamp of the thread catcher;

(ix) clamping the at least one cut weft yarn section so that it is pulled completely out of the fabric due to the retraction motion of the cutter and combined hooked needle & thread catcher are retracted;

(x) examining the cutter and the combined hooked needle & thread catcher with sensing means to ensure damage has not occurred during the pull out process;

(xi) releasing the at least one cut weft yarn section from the yarn catcher clamp;

(xii) advancing the yarn removal device in the MD;

(xiii) repeating steps (iii) through (xii) until a desired number of CD oriented yarns are removed from the edge of the woven industrial textile along the desired CD distance;

(xiv) retracting the cutter and combined hooked needle & thread catcher from the fabric;

(xv) releasing the first portion of the clamped fabric;

(xvi) displacing the cutter and combined hooked needle & thread catcher a desired distance along the fabric edge to a position where further yarn removal is to continue; and (xvii) repeating steps (iv) through (xvi) until all of the weft yarns in a desired MD length of fabric are removed.

Preferably, the fabric is a woven industrial textile having a single warp and weft yarn system. Alternatively, the fabric is a woven industrial textile having more than one warp system whose component yarns are arranged in layers. As a further alternative, the fabric is a woven industrial textile having more than one weft system whose component yarns are arranged in layers. In yet another alternative, the industrial textile has more than one warp and weft system whose component yarns are arranged to provide at least two, or more than two, fabric layers.

BRIEF DESCRIPTION OF THE DRAWINGS

Preferred embodiments of the present invention will now be described, by way of example only, with reference to the attached Figures, in which.

DETAILED DESCRIPTION OF THE DRAWINGS

In the following description and throughout the specification, certain terminology is used for convenience only and is not considered limiting. The words "lower" and "upper", "up" and "down" designate directions in the Figures to which reference is made. The term "CD" refers generally to the cross-machine direction of a fabric which is to be fringed and, in the case of flat woven fabrics, will be a direction generally parallel to the component weft yarns in the fabric. The term "MD" refers to the machine direction, or direction of travel of the fabric when in use as a moving belt, such as in a papermaking machine or similar apparatus, and will indicate a direction generally parallel to the component warp yarns in the fabric. If the fabric is endlessly woven in the manner of a tube or sock, then the warp yarns will be oriented in the CD and the weft in the MS. The terms "textile" and "fabric" are used interchangeably as are the terms "thread" and "yarn".

Figure 1:
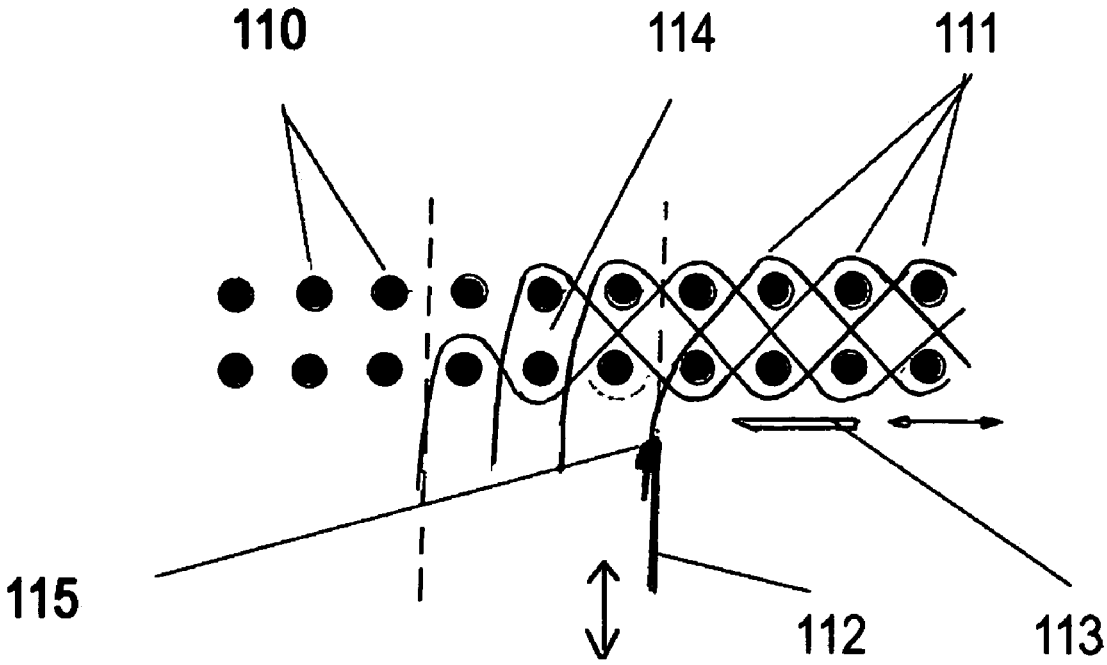
FIG. 1 is a cross-section of an industrial textile, taken along the CD and illustrating a prior art method of removing the weft.

FIG. 1 illustrates a prior art method for the automated removal of CD yarns from an industrial textile. In this Figure, the industrial textile 114 consists of MD oriented warp yarns 110 interwoven with CD oriented weft yarns 111, which are to be removed. In the illustrated prior art method, a needle 112 which is driven by a reciprocating motor (not shown) is pushed up through the fabric 114, pierces the fabric, and then pulls out a tail portion of a CD oriented weft yarn 111 on its down stroke. The needle then continues downwardly below the plane of the fabric 114 to provide sufficient space for a cutter 113 which moves perpendicular to the needle 112 and parallel with the fabric 114, to cut the tail portion of the weft yarn 111 extending below the plane of the fabric. The action of cutting and pulling the weft yarn 111 creates a significant amount of friction between the needle hook 115 and the weft 111. This may cause undesirable damage, distortion and/or breakage of the MD yarns 110.

Figure 2:
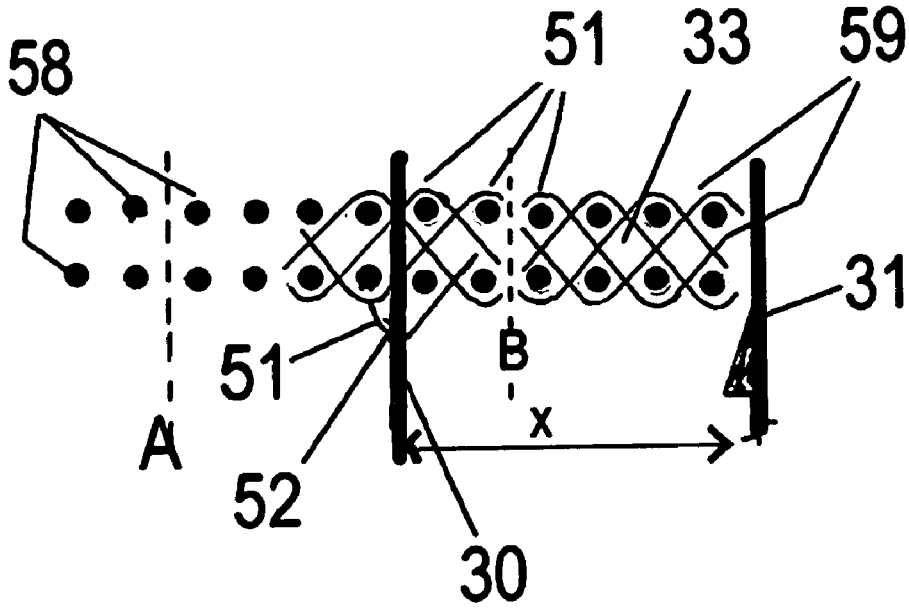
FIG. 2 is a cross-section of an industrial textile, taken along the CD and illustrating the method of removing the weft according to the present invention.
Figure 3:
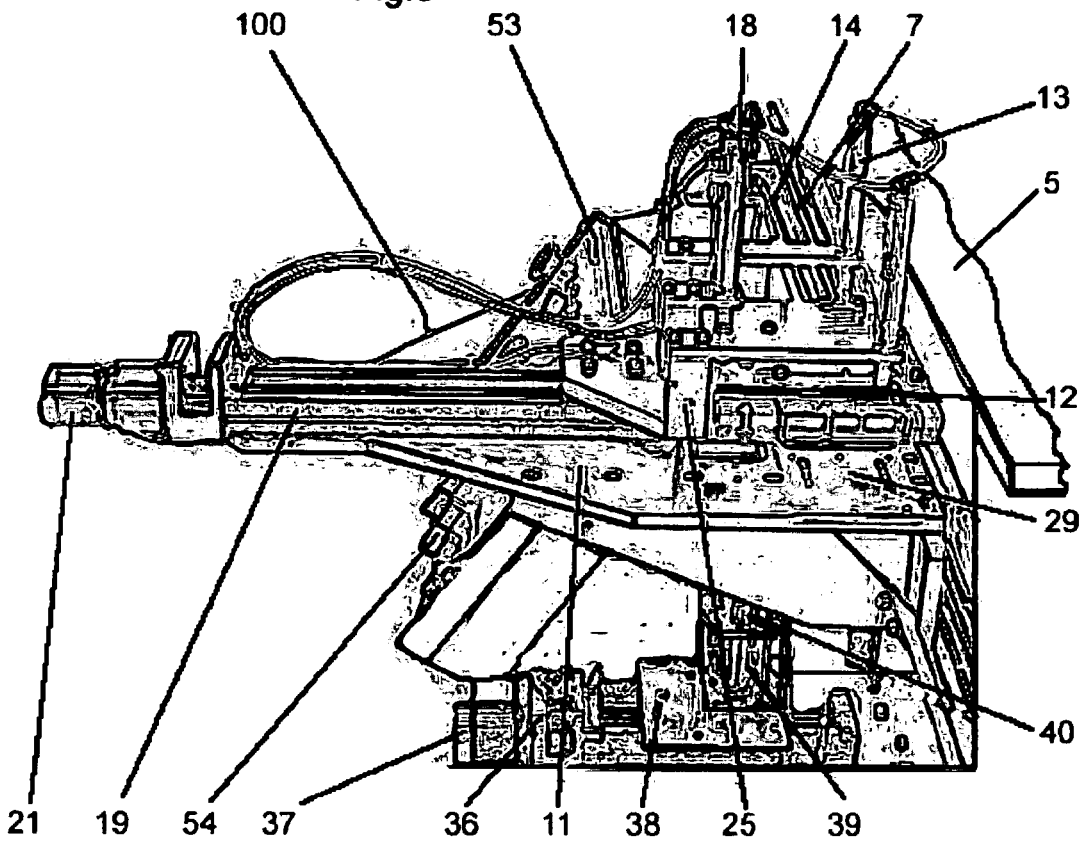
FIG. 3 is a photograph of an apparatus according to the invention showing the position of the unraveling assembly on top of the frame.

FIG. 2 schematically illustrates a yarn removal process arranged in accordance with the teachings of the present invention. In FIG. 2, the industrial textile 33 includes MD yarns 58 and CD yarns 59. Cutter blade 31 and the combined hooked needle & thread catcher assembly 30 are shown located a pre-selected distance X apart in the fabric. In the yarn removal process of this invention, the cutter 31 and the combined hooked needle & thread catcher assembly 30 first pierce the fabric in a selected starting location; thereafter, these two units move together in tandem and do not leave the channel they create between set of warp yarns 58. The cutter 31 and catcher assembly 30 move up and down in a reciprocating fashion; on the up stroke, the cutter 30 severs at least one CD yarn 59 creating cut sections 51. On the down stroke, the hook 52 of the combined hooked needle & thread catcher assembly 30 grasps the cut CD yarns section 51 and pulls them out of the fabric 33. Because the sections 51 are precut by the cutter 31, there is very little friction between the thread section 51 and the hook 52 during the removal motion. Note that the upper tips of the combined hooked needle/thread catcher assembly 30 and cutter 31 both remain in the fabric 33 until a desired MD length of fabric has been created, at which point the units 30 and 31 are retracted below the plane of the fabric and moved in the CD to the next cutting location. Due to the fact that the weft yarns 59 are precut prior to their removal, breakage or damage of the warp 58 is minimized.

The operation and components of the yarn removal apparatus is shown in the photographs labeled FIGS. 3 through 7. As shown in these Figures, the yarn removal apparatus 100 of the invention is movably mounted on frame 4 which is provided with a guide rail 7 upon which the apparatus 100 will move. Frame 4 will have sufficient length to accommodate the width of the industrial textile that is to be unraveled.

Apparatus 100 includes movable table 11 which is movable in the CD along guide rail 7 attached to frame 4. Motor 23 powers pulley 15 to provide CD motion of the apparatus 100 along stationary timing belt 14. A clamping device 12 to hold textiles 33 that are to be worked upon for yarn removal is located on top of movable table 11. Pneumatic cylinders 13 operate to secure the textile 33 in place by means of clamp plate 1. Clamping device 12 is mounted on slide 19 and is driven backwards and forwards by gear motor 21 to provide free access to the components of the yarn removal device for necessary adjustment and/or replacement of components as well as to give free space to place the fabric 33 in position before starting the yarn removal process. Enclosure 53 houses electronic controls which are accessible by means of panel 54. The displacement distance of apparatus 100 along the guide rail 7 is controllable by means of a commercially available electronic control system such as are available for example with stepper motor Model no. PK299 available from Vexta Stepper Motors.

Figure 4:
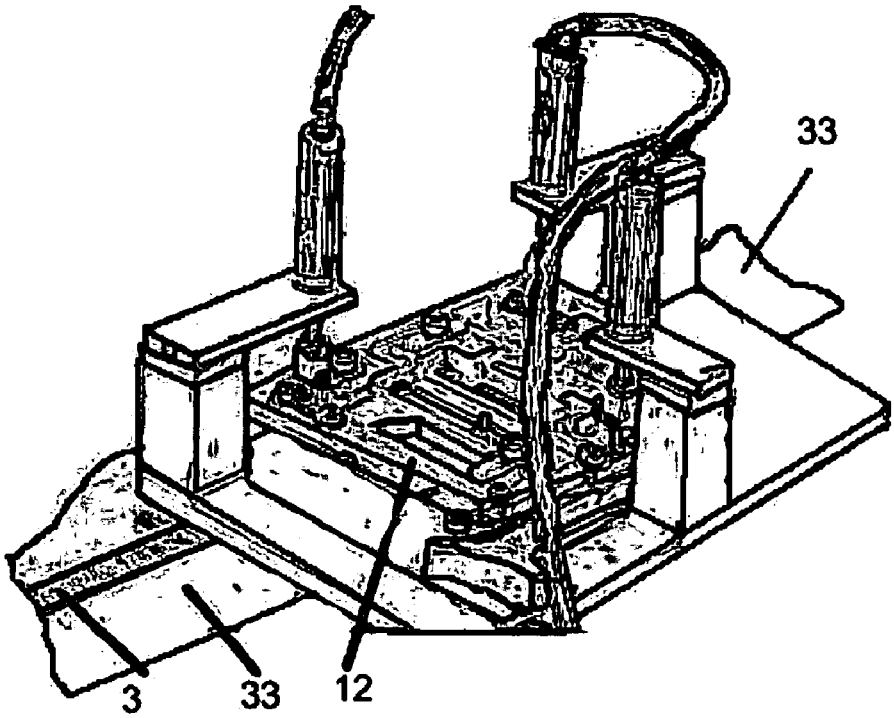
FIG. 4 is a close-up photograph of the unraveling assembly on the apparatus shown generally in FIG. 3.

FIG. 4 shows a fabric 33 in position in the yarn removal apparatus 100 of the invention. The fabric 33 is securely held in place by the clamping device 12 so that it is accessible by the cutter 31 and the combined hooked needle & thread catcher assembly 30 which are best seen in FIGS. 16 through 22 and which are located beneath clamping device 12.

Figure 5:
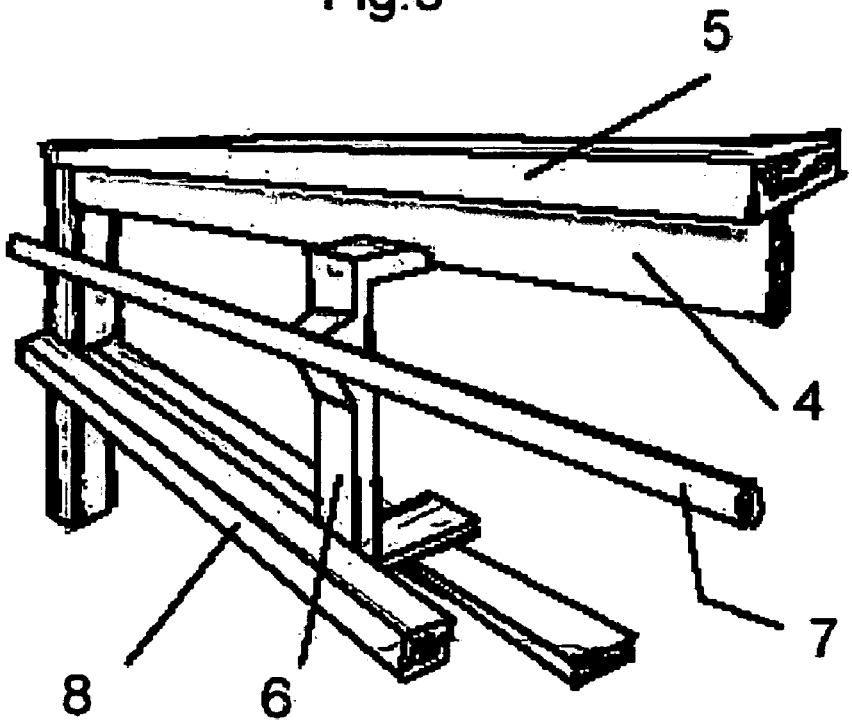
FIG. 5 is a photograph showing a partial view of the front end of the frame along which the unraveling device moves parallel to the edge of the fabric (not shown).

As shown in FIG. 5, guide rail 7 accurately guides yarn removal device 100 as it moves along frame 4. The frame 4 can be as long as 39 feet (12 m) or longer in order to accommodate wide fabrics for weft yarn removal. Guide rail 7 is supported by supports 6 located at regular intervals along frame 4 to resist bending or distortion over the length of the frame. A guide tube 8 is also mounted to the frame and runs parallel with guide rail 7. Roller bearings attached to the apparatus 100 run against the guide tube 8 to ensure stable motion of apparatus 100 along the frame 4. Frame surface 5 supports the fabric 33 on top of the frame 4.

Figure 6:
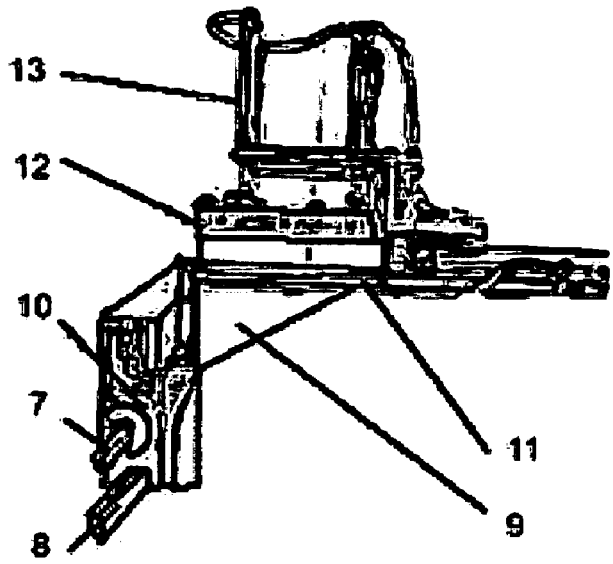
FIG. 6 is a photograph of a partial side view of the unraveling device shown in FIG. 5.

FIG. 6 is a side view of the fabric clamping device 12 as located on movable table 11 which is supported by stabilizer 9. Pneumatic cylinders 13 or other suitable linear power units, move the clamping device 12 from a released position into a clamping position so as to securely hold a fabric. Table 11 is also equipped with at least two bearings 10, one on each side of table 11; bearings 10 slide along guide rail 7 while guide tube 8 stabilizes the apparatus 100 and ensures a straight run from one side of the frame to the other.

Figure 7:
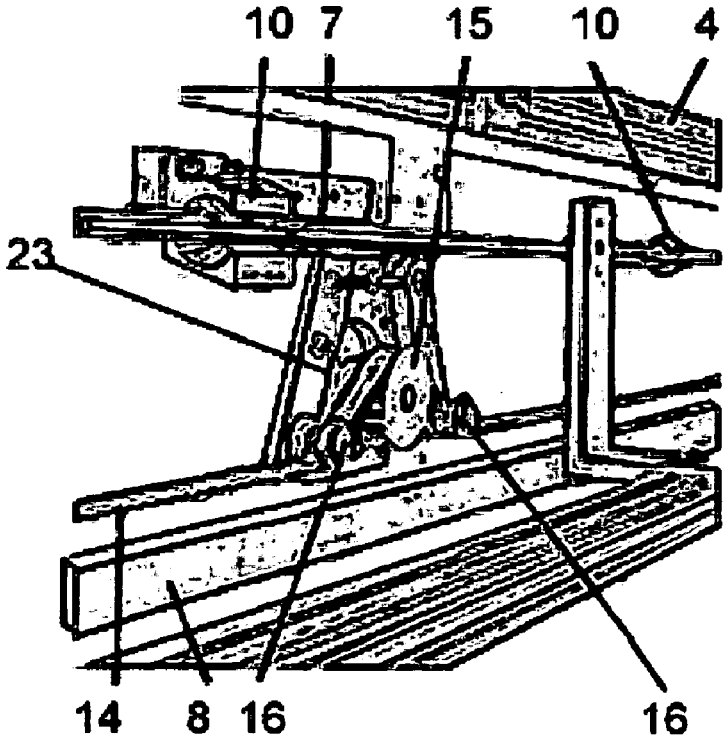
FIG. 7 is a photograph showing the rear of the unraveling device, showing the motion system used to move the device along the frame.

FIG. 7 shows apparatus 100 from the back side, including bearings 10 which slide on guide rail 7, and guide tube 8. Timing belt 14 runs the length of frame 4 and is parallel to guide rail 7 and guide tube 8. Apparatus 100 is moved in the CD by turning pulley 15 which is driven by stepper motor 23 in pre-selected increments, either clockwise or counter clockwise, depending on the desired direction of movement. Tension pulleys 16 ensure an appropriate angle of contact between the pulley and the timing belt. In operation, apparatus 100 removes the CD yarns from a portion of the fabric 33 to form a channel 3; apparatus 100 is then moved incrementally in the CD by means of pulley 15 to begin the yarn removal process at a new adjacent location.

Figure 8:
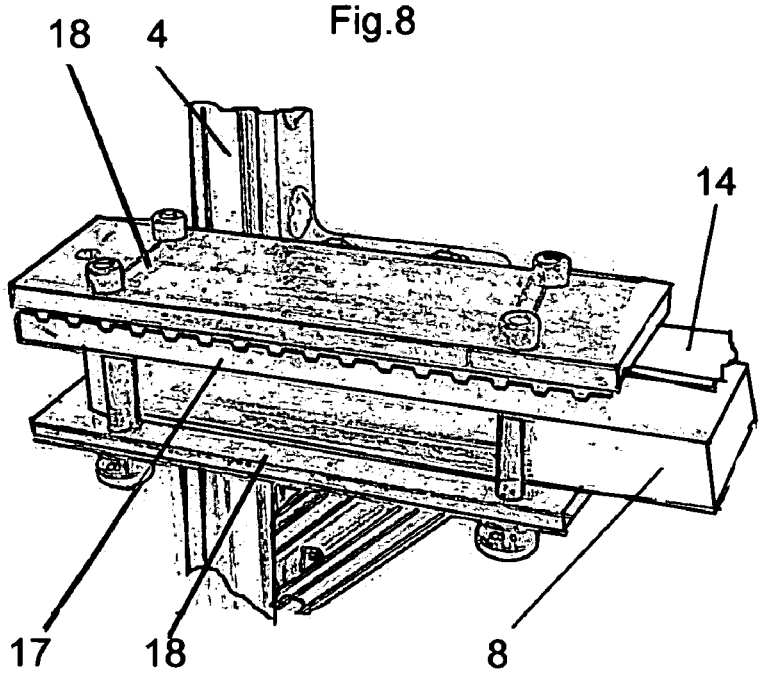
FIG. 8 is a photograph showing the stationary belt attachment on one end of the frame which is used for the transversal motion of the unraveling device.

FIG. 8 shows the attachment of the timing belt 14 to one end of the frame 4 Holding plate 17 has tooth-like cutouts corresponding to the shape and spacing of the teeth of timing belt 14. Clamping plates 18 are tightened together around guide tube 8, holding belt 14 in position.

Figure 9:
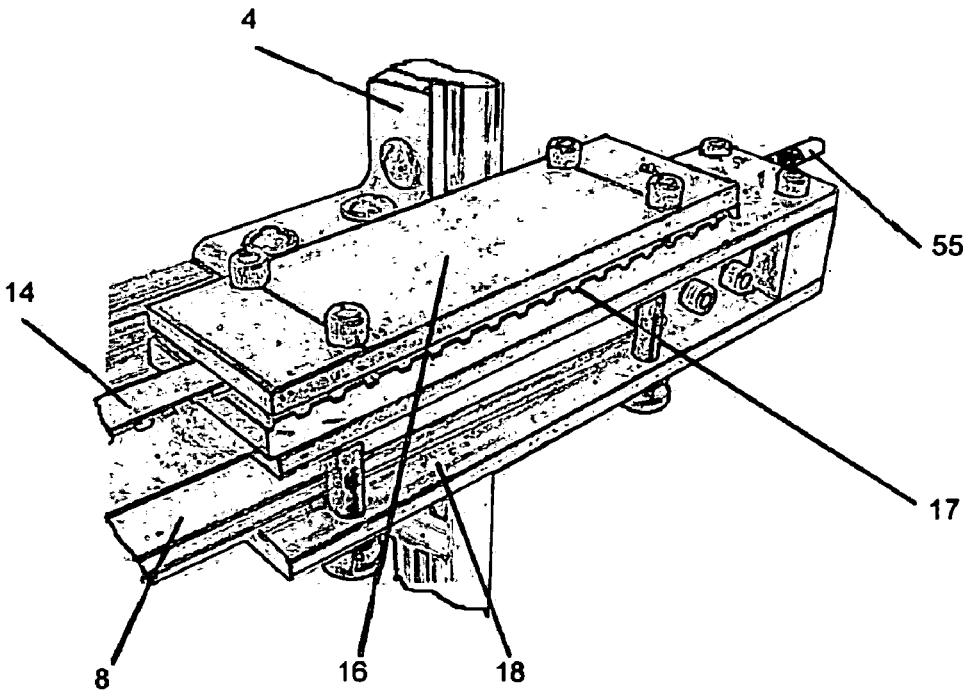
FIG. 9 is a photograph showing the belt tension adjustment means on the opposite end of the frame shown in FIG. 8.

FIG. 9 shows the attachment of timing belt 14 to the opposite end of the frame 4 shown in FIG. 8. Holding plate 17 is assembled together with both clamping plates 18 and is provided with tension screw 55. Timing belt 14 is tensioned by turning screw 55 creating a sliding motion of the tensioning device along guide tune 8.

Figure 10:
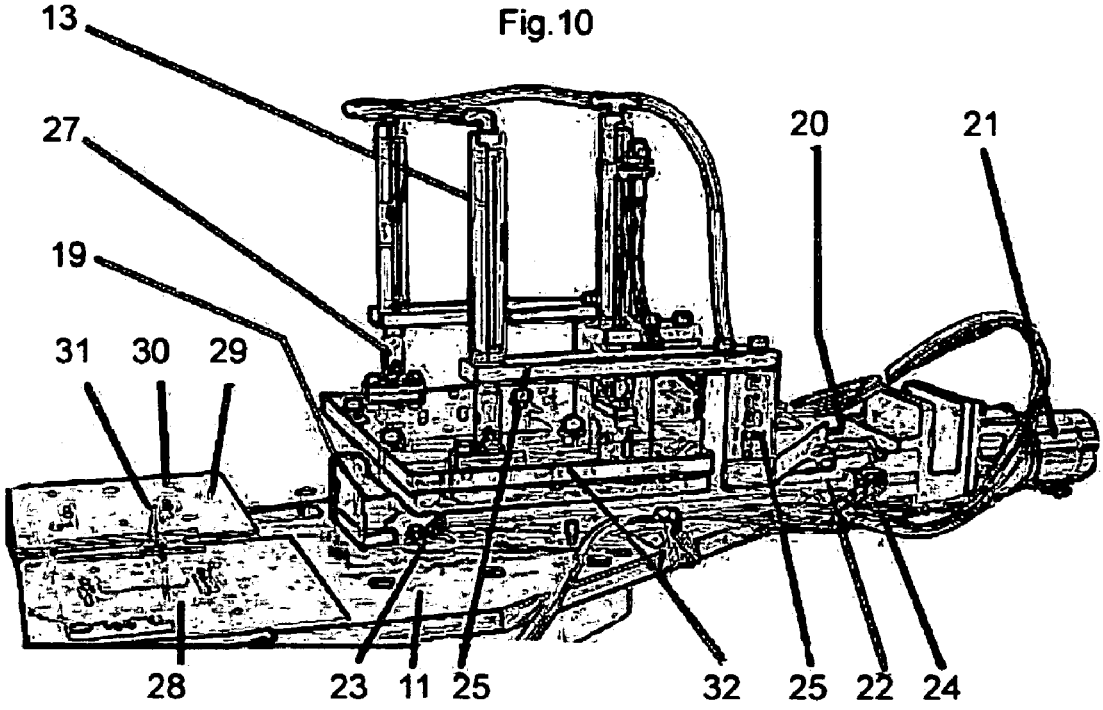
FIG. 10 is a photograph showing the fabric clamping system used to hold fabrics in place for unraveling.

FIG. 10 is a side view showing fabric clamp plate 1, connected by a pivoting bracket 27 to pneumatic cylinder 13, mounted with mounting support 25 to slide 19. Cutter 31 and combined hooked needle & thread catcher assembly 30 are exposed as the table 11 is pulled back and away from these components by means of screw 20 which is movable by gear motor 21. Also visible are the two sideways movable fabric support 28 and 29 located on top of the table 11. The position of these supports is adjustable so that the slot formed between them for the passage of the needle 30 and the cutter 31 can be set to equal the length of the section of thread to be removed.

Figure 11:
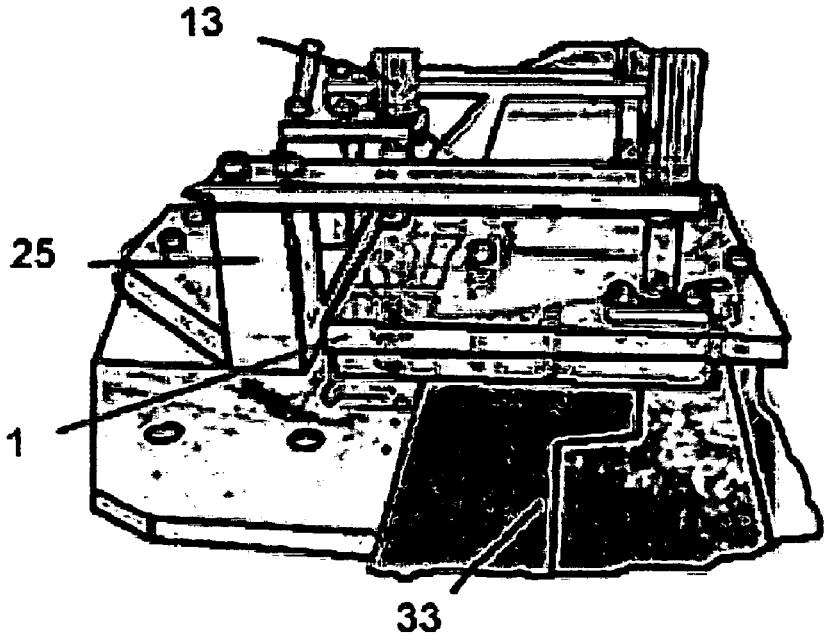
FIG. 11 is a close-up photograph showing the transparent fabric clamping device in its working position.
Figure 12:
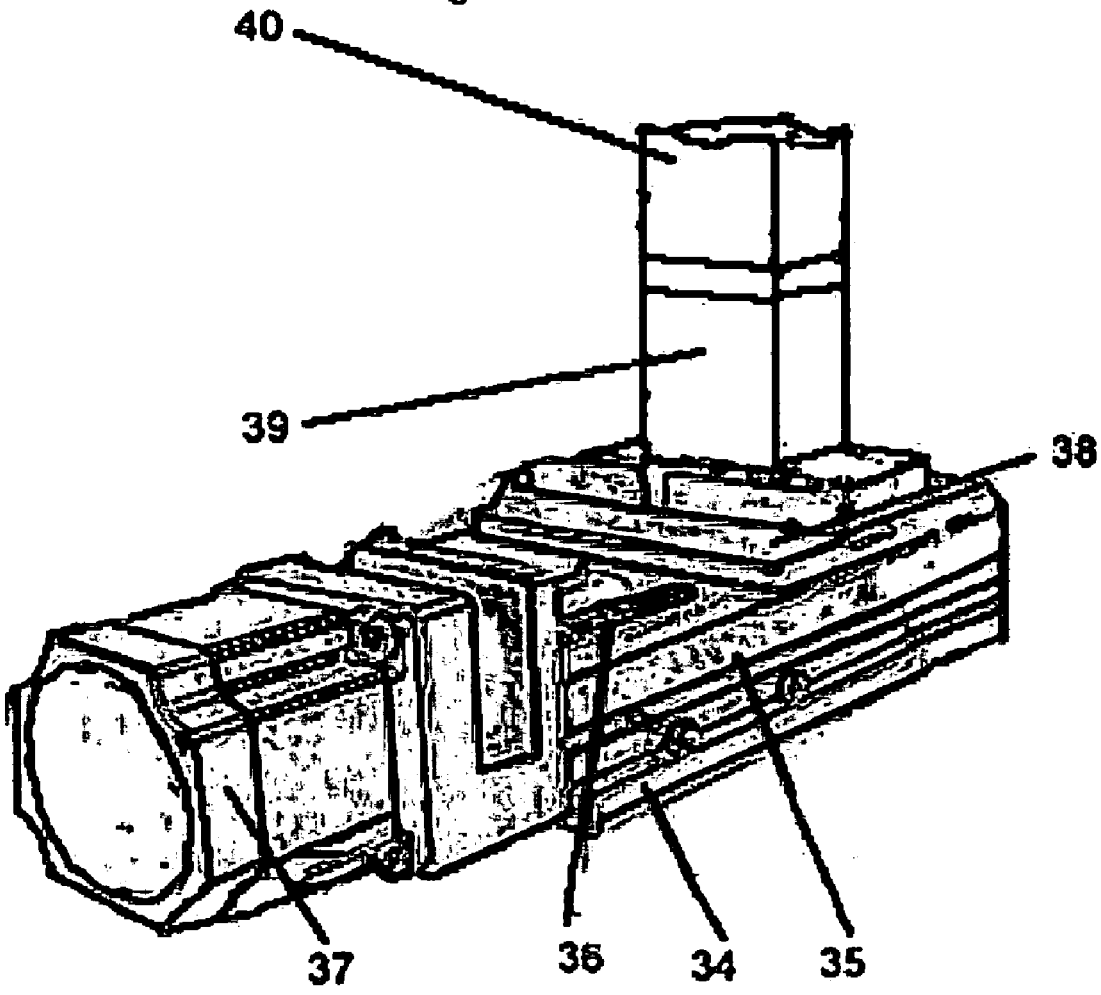
FIG. 12 is a photograph showing the slide unit for the unraveling device.

FIG. 11 is the side view of the apparatus shown in FIG. 10 showing the fabric clamping plate 1 mounted on its support 25 held by pneumatic cylinder 13 in its clamping position so as to hold fabric 33 in position for yarn removal.

The yarn removal device is shown in detail in FIGS. 12 through 22. The yarn removal device consists of base plate 38, and two linear power units, in this embodiment lower pneumatic cylinder 39 and upper pneumatic cylinder 40 which are arranged together so as to be perpendicular to the plane of the fabric 33 when located in clamping device 12. The piston of the lower cylinder 39 is attached to base plate 38, and is mounted so as to be back-to-back with upper cylinder 40. The combined hooked needle & thread catcher assembly 30 and the cutter 31 are mounted on top of cylinder 40. The yarn removal device is attached to base plate 38 which is movable in a precise controlled manner in the MD on slide 35 by screw 36 which is powered by e.g. a rotating stepping device such as stepper motor 37.

Figure 13:
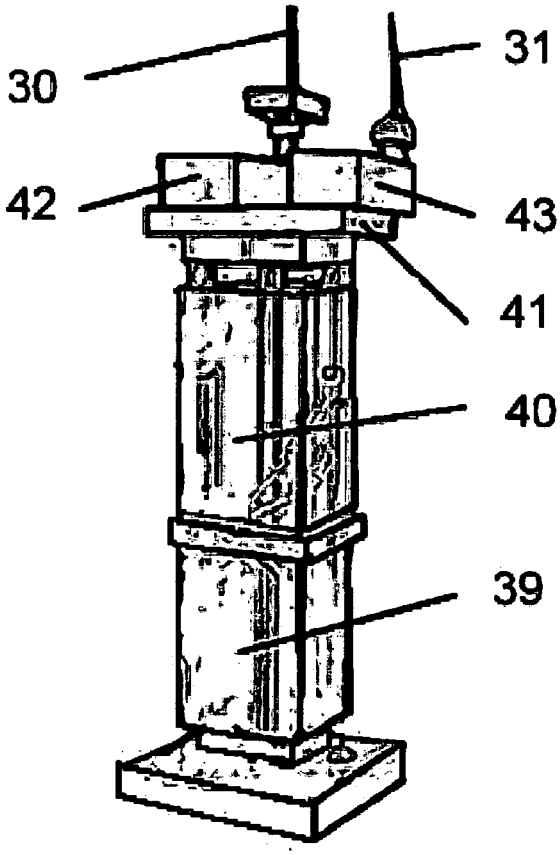
FIG. 13 is a photograph showing the unraveling device in its "home" position.
Figure 14:
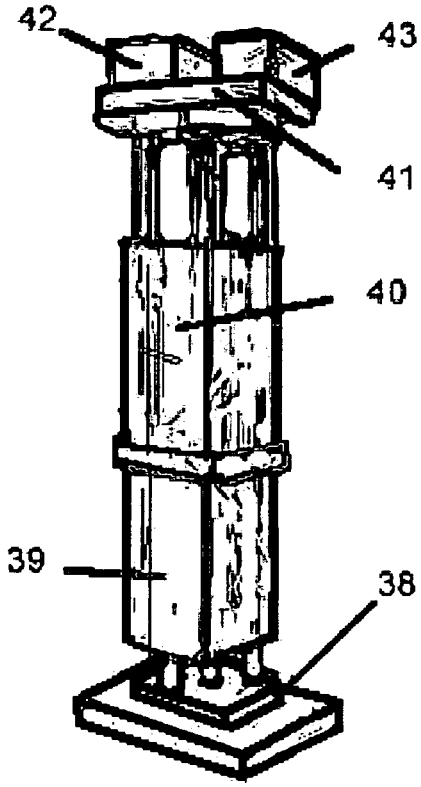
FIG. 14 is a photograph showing the unraveling device in its "top position" where both the cutter and the combined pull needle/thread catcher are in an extended position.
Figure 15:
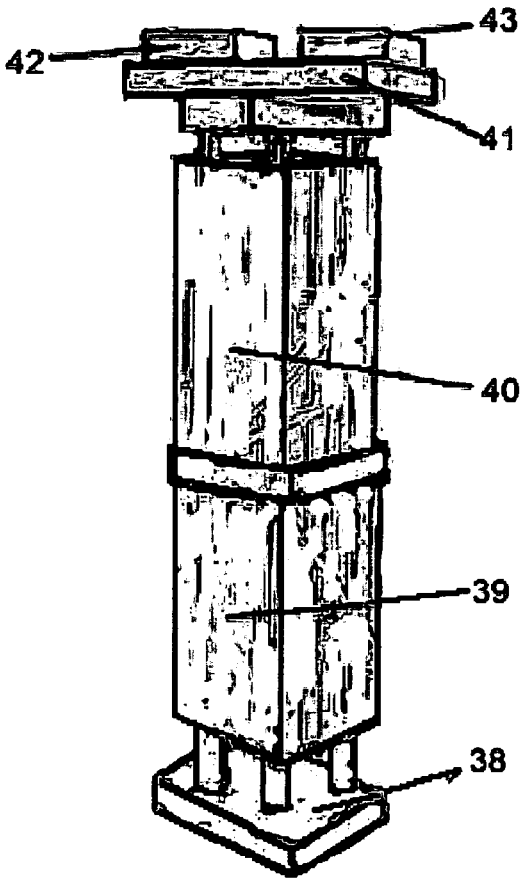
FIG. 15 is a photograph showing the unraveling device in their "middle position", where the combined pull needle/thread catcher releases a section of weft yarn which has been pulled out of the fabric being fringed.

The yarn removal device is caused to cycle through 3 different positions as shown in FIGS. 13,14 and 15. The combined hooked needle & thread catcher assembly 30 mounted to the piston of the upper cylinder 40 is shown in detail in FIGS. 16 and 17.

FIG. 13 is a front view of the yarn removal apparatus of the invention showing the combined hooked needle & thread catcher assembly 30, the cutter 31, base plate 38, lower cylinder 39 and upper cylinder 40 in its "home" position. Piston plate 41 attached to the piston of the upper cylinder 40 is the support for the cutter bracket 43, holding the cutter 31, and the combined needle & thread catcher bracket 42, holding thread catcher 44 and the hooked needle 30. The tip of the cutter 31 and needle 30 in this home position are underneath the fabric. In this position, when fabric clamping device 12 is retracted from its clamping position, it is possible to displace the apparatus 100 stepwise in CD to the next yarn removal cycle or to move it back to its starting position on one end of the frame.

FIG. 14 is also a front view of the yarn removal apparatus of the invention in its "top" or completely extended position. This extension is perpendicular to the plane of the fabric to be prepared and is achieved by extending both the lower cylinder 39 and the upper cylinder 40. It can be seen that the cylinder 39 located on the base plate 38 displaces the piston plate 41 with cutter bracket 43 and needle bracket 42 in its top position, thereby piercing the fabric (see FIG. 24).

FIG. 15 is another front view showing the yarn removal apparatus in its "middle" position. In this position, a thread section is pulled out of the plane of the fabric but the tip of the cutter and needle are still inserted in the plane of the fabric.

Figure 16:
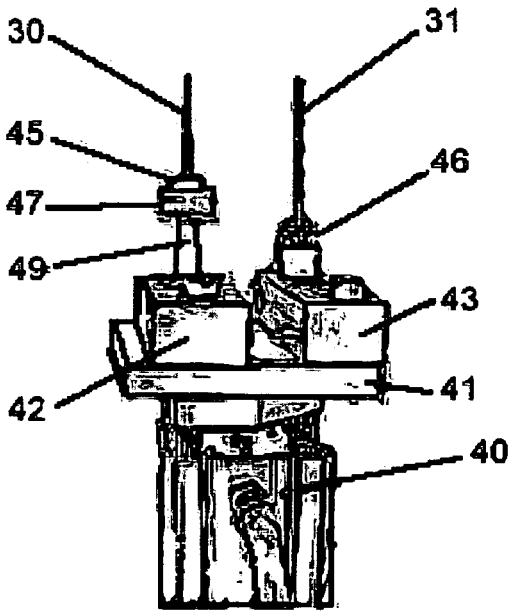
FIG. 16 is a photograph showing the cutter and combined pull needle/thread catcher assembly.

FIG. 16 is a close up view of the cutter 31 and the combined hooked needle & thread catcher assembly 30, shown in the "home" position. FIG. 16 shows the upper cylinder 40 with the piston base plate 41 and the attached brackets for the cutter 43 and the needle and thread catcher 42. Brackets 42 and 43 are sideways adjustable and need to coordinate with the lateral displacement of apparatus 100 along the frame to make sure that the needle hooks a CD yarn, grasping the cut thread section approximately in the middle between two cutting lines. The cutter 31 is clamped to the holder 46. The needle is fixedly mounted fix into the bracket 42. Also mounted to bracket 42 is the thread catcher cylinder, not visible in this view but shown in FIG. 19, with its piston 48. Thread catcher bracket 47 is attached to the thread catcher piston 48 which is spring loaded so as always move into the extended position. Thread catcher bracket 47 has a slot in which the needle 30 can freely slide up and down.

Figure 17:
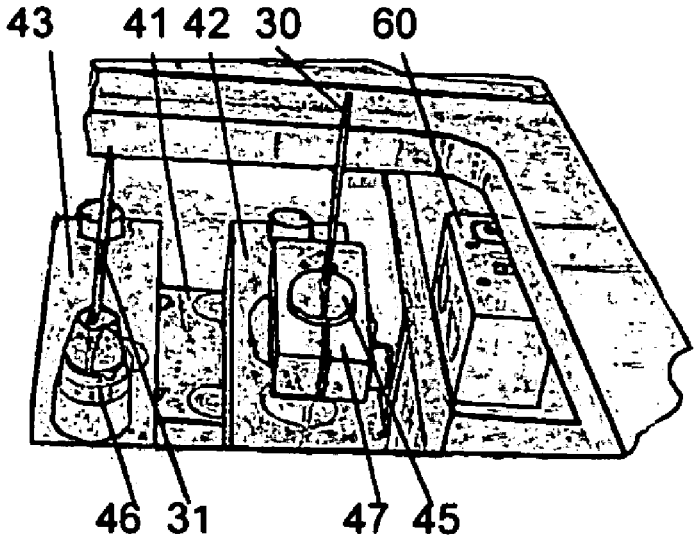
FIG. 17 is a photograph showing the cutter and combined pull needle/thread catcher assembly in extended position.

FIG. 17 is a top view of the cutter 31 and combined hooked needle & thread catcher assembly 30 showing also the upper pneumatic cylinder base plate 41, the cutter bracket 43, and the cutter holder 46. Also shown are the needle bracket 42 the thread catcher bracket 47 with the insert 45 clearly visible in the slot in which needle 30 may slide up and down. Optical sensor 60 examines the needle 30 for any potential damage or breakage and will stop the machine in case any damage is detected.

Figure 18:
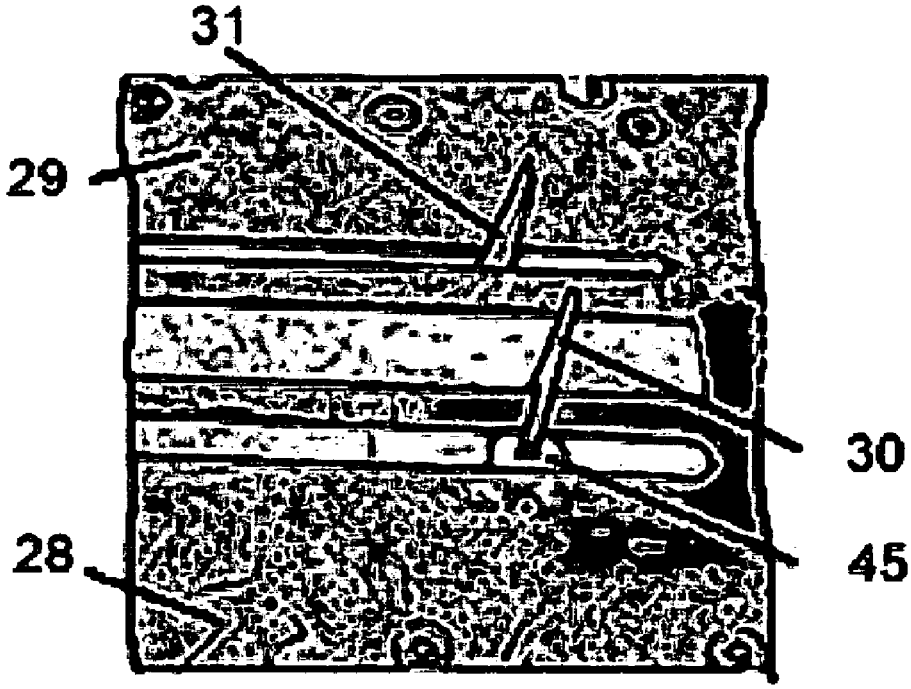
FIG. 18 is a close-up photograph of the apparatus shown in FIG. 17.

FIG. 18 is a top view showing the fabric support plates 28 and 29 of which each plate has a slot for the passage of one of the cutter 31 and the combined hooked needle & thread catcher assembly 30. As indicated earlier, the fabric support plates 28 and 29 are laterally adjustable depending on the length of the thread section 51 to be removed. Also visible in its top position is thread catcher insert 45. In operation, only the hooked needle continues to move to the top position such that it is free to grasp a thread section to be removed in its down stroke motion.

Figure 19:
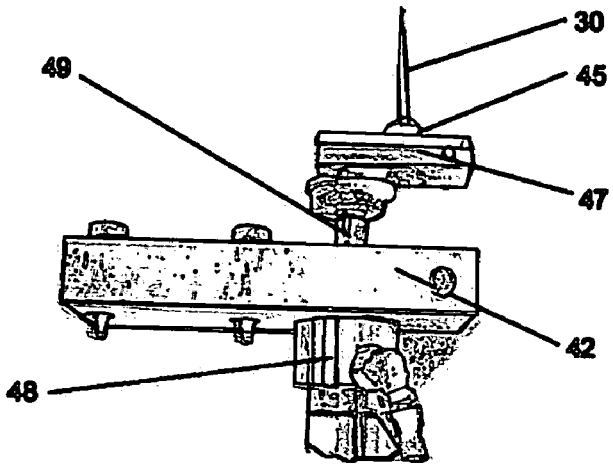
FIG. 19 is a photograph taken from the side of the apparatus shown in FIG. 17 showing of the thread catcher assembly.

FIG. 19 is a side view of the combined hooked needle & thread catcher assembly 30. Thread catcher cylinder 48 is mounted into the bracket 42. Attached to the cylinder piston 49 is the thread catcher bracket 47 with insert 45, in which needle 30 may slide freely. Piston 49 is spring loaded and is shown in its extended position.

Figure 20:
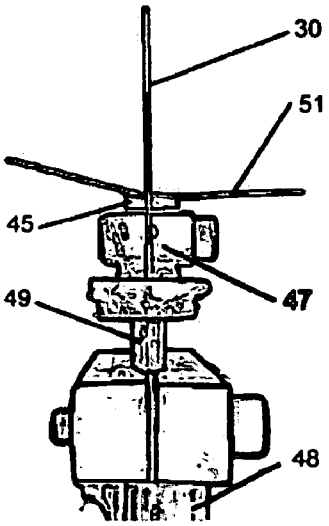
FIG. 20 is a photograph taken from the front of the apparatus shown in FIG. 17 and showing the thread catcher holding a pulled out thread section.

FIG. 20 shows the combined hooked needle & thread catcher assembly 30 in its "middle" position as described in association with FIG. 15 clearly showing a captured and removed thread section 51 between the needle hook of needle 30 and the thread catcher insert 45.

Figure 21:
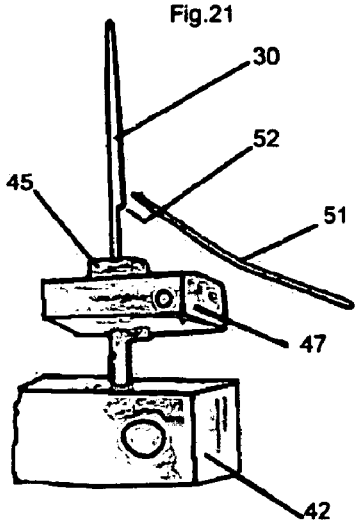
FIG. 21 is a photograph taken from an oblique angle of the apparatus shown in FIG. 17 with the thread catcher in its retracted position, releasing the pulled out thread section.

FIG. 21 is a side view of the combined hooked needle & thread catcher assembly similar to FIG. 20 including needle bracket 42, thread catcher insert 45, thread catcher bracket 47, removed thread section 51, and needle hook 52. In operation, when the assembly 30 is in its "middle" position, the thread catcher cylinder 48 is activated, the piston 49 is retracted for a fraction of a second and the grip between the needle hook 52 and the catcher insert 45 is opened, letting the removed thread section 51 fall out of the grasped position.

Figure 22:
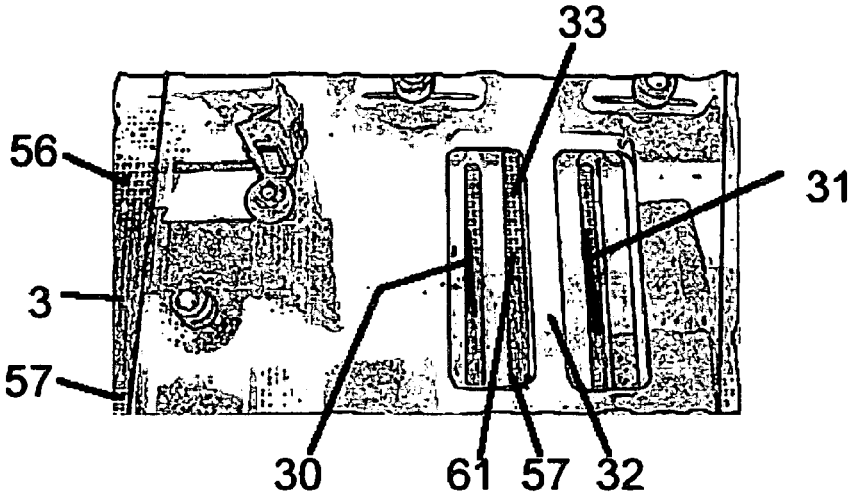
FIG. 22 is a close-up photograph from the top of the unraveling device, looking through the transparent fabric clamping device.

FIG. 22 is a top view looking through the transparent fabric clamping plate 1. Visible are combined hooked needle & thread catcher assembly 30, cutter 31, fabric 33, the start line 57 of the open channel 3 in the fabric 33 with CD threads removed up to the end line 56 on the left side for the full width of the channel 3, and in the working area proximate the cutter 31 and thread catcher assembly 30, having partially removed CD threads until the line 61, representing a line of partial removed threads in channel 3.

Figure 23:
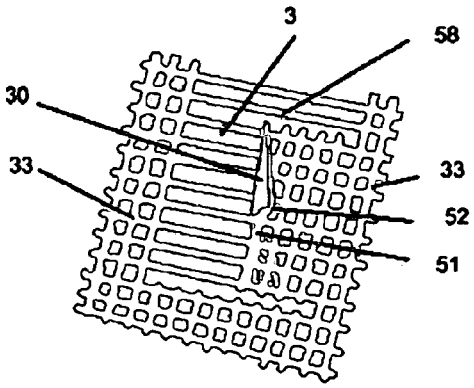
FIG. 23 is a photograph showing the needle hook used to grasp a thread section to be pulled out of the fabric.

FIG. 23 is a close up view of the fabric shown in FIG. 22 showing the fabric 33 with the longitudinal threads 58 remaining in the channel 3, the needle of the combined hooked needle & thread catcher assembly 30 with needle hook 52, ready to grasp a thread section 51 to be removed.

Figure 24:
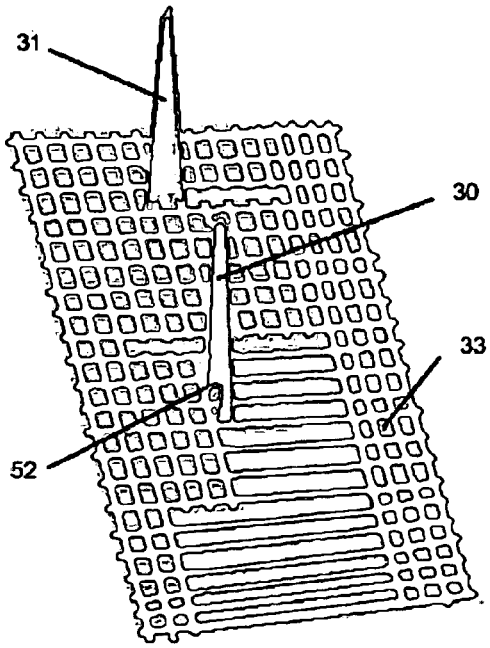
FIG. 24 is a photograph showing the cutter and hooked needle in its top position, ready to grasp a thread section to be removed from the fabric.

FIG. 24 is another close up view of the fabric 33 showing the cutter 31 and the needle of the combined hooked needle & thread catcher assembly 30 in the top position of the yarn removal cycle. As can be seen, the cutter 31 cuts thread sections along a line formed between two MD oriented yarns while needle of assembly 30 follows in parallel between another pair of MD oriented yarns. Hook 52 of assembly 30 is shown grasping a cut thread section on its downward stroke, ready to take a section of a CD thread out of the plane of fabric 33. It is apparent that the CD thread has been cut by the cutter 31 prior to its removal. Thus there is little if any friction between the yarn to be removed and the fabric.

The invention claimed is:

1. An apparatus for the removal of one or more CD oriented yarns from an edge of a woven industrial textile having first and second planar surfaces and comprised of a plurality of interwoven warp and weft yarns oriented transversely to one another in each of the machine direction (MD) and cross-machine direction (CD), the apparatus comprising:

a frame that is at least equal in length to the width of the fabric from which the yarns are to be removed;

a movable table including:

a motorized mounting system attached to the frame, the mounting system capable of moving the table a desired distance along the frame in a direction generally parallel to the CD direction of the fabric;

a clamping device adapted to securely hold that portion of the fabric from which yarns are to be removed; and a yarn removal device, consisting of a cutter and a combined hooked needle & thread catcher, wherein;

the yarn removal device is movable in a vertical direction out of the fabric plane, and in a horizontal direction parallel to the MD direction;

the distance between the cutter and combined hooked needle & thread catcher in the yarn removal device is adjustable;

the yarn removal device is caused to reciprocate cyclically such that:

in a first part of the cycle, the yarn removal device is raised and each of the cutter and combined hooked needle & thread catcher pierces a first planar surface of the fabric thereby passing between the component warp and weft yarns at two locations a pre-selected distance apart;

the cutter cuts one or more weft yarns as it passes between the component warp and weft so as to provide cut weft thread sections;

in a second part of the cycle, the hook of the combined hooked needle & thread catcher grasps the one or more pre cut weft yarn section(s) and pulls them down into the clamp of the thread catcher, thereby holding the hooked weft yarn section(s) firmly and pulling the section(s) completely out of the fabric as the cutter and combined hooked needle & thread catcher are retracted from the first planar surface;

in a third part of the cycle, the thread catcher releases the pulled out cut weft yarn section, and the cutter and combined hooked needle & thread catcher are moved in a horizontal direction parallel to the MD to the next uncut weft yarn(s), and the cycles repeat until a desired width of longitudinal channel is obtained;

the table is moved in a direction generally parallel to the CD of the fabric and the cycle is repeated until sufficient CD yarns are removed from a desired width and length of the fabric.

2. An apparatus according to claim 1 further including more than one yarn removal device.

3. An apparatus according to claim 1 where different shapes and sized hooked needle(s) and cutter(s) are used depending of the woven materials pattern and the diameters and shapes of the threads to be removed.

4. A method of removing one or more CD oriented yarns from an edge of a woven industrial textile, the method comprising:

(i) providing a woven industrial textile containing interwoven warp and weft yarns;

(ii) clamping a first portion of the textile from which the CD oriented yarns are to be removed;

(iii) locating a yarn removal device, consisting of a cutter and a combined hooked needle & thread catcher assembly, at a first location in the fabric edge where yarn removal is to begin;

(iv) separating and locating the individual cutter and combined hooked needle & thread catcher a desired CD distance from each other;

(v) simultaneously piercing the industrial textile from one side with both the cutter and the combined hooked needle & thread catcher at separate locations spaced apart from one another parallel to the CD;

(vi) cutting one or more weft yarns with the cutter;

(vii) examining the cutter and hooked needle & thread catcher with sensor means to ensure damage has not occurred during the piercing process;

(viii) retracting the cutter and combined hooked needle & thread catcher such that the hook on the combined hooked needle & thread catcher captures at least one cut weft yarn section and pulls the section into the clamp of the thread catcher;

(ix) clamping the at least one cut weft yarn section so that it is pulled completely out of the fabric due to the retraction motion of the cutter and combined hooked needle & thread catcher;

(x) examining the cutter and the combined hooked needle & thread catcher with sensing means to ensure damage has not occurred during the pull out process;

(xi) releasing the at least one cut weft yarn section from the clamp;

(xii) advancing the yarn removal device in the MD;

(xiii) repeating steps (iii) through (xii) until a desired number of CD oriented yarns are removed from the edge of the woven industrial textile along the desired CD distance;

(xiv) retracting the cutter and combined hooked needle & thread catcher from the fabric;

(xv) releasing the first portion of the clamped fabric;

(xvi) displacing the cutter and combined hooked needle & thread catcher a desired distance along the fabric edge to a position where further yarn removal is to continue; and (xvii) repeating steps (iv) through (xvi) until all of the weft yarns in a desired MD length of fabric are removed.

5. A method according to claim 4 where said longitudinal advancing step (xii) is performed for a pre selected distance to create a parallel channel where all lateral threads are removed.

6. A method according to claim 5 where other then parallel formed channels are created.

7. A method according to claim 4, 5 or 6 where multiple yarn removal devices are in operation to increase the speed of yarn removal.

* * * * *